United States Patent [19]

Glanvall

[11] Patent Number: 4,488,858

[45] Date of Patent: Dec. 18, 1984

[54] COMPRESSOR WITH RADIAL INLET TO SCREW-FORMED ROTOR

[75] Inventor: Rune V. Glanvall, Norrkoping, Sweden

[73] Assignee: Stal Refrigeration AB, Norrkoping, Sweden

[21] Appl. No.: 413,247

[22] Filed: Aug. 30, 1982

[30] Foreign Application Priority Data

Sep. 15, 1981 [SE] Sweden ..... 8105471

[51] Int. Cl.[3] ..... F04C 18/14

[52] U.S. Cl. ..... 418/195; 418/201

[58] Field of Search ..... 418/191, 195, 196, 197, 418/201, 202

[56] References Cited

U.S. PATENT DOCUMENTS

| | | | |
|---|---|---|---|
| 2,289,371 | 7/1942 | Lysholm | 418/202 |
| 3,088,659 | 5/1963 | Nilsson | 418/201 |
| 3,491,730 | 1/1970 | Nilsson | 418/201 |
| 4,261,691 | 4/1981 | Zimmern | 418/195 |

*Primary Examiner*—John J. Vrablik
*Assistant Examiner*—Jane E. Obee
*Attorney, Agent, or Firm*—Cyrus S. Hapgood

[57] ABSTRACT

In a compressor having at least two cooperating rotors of which at least one has a screw form, the medium to be compressed is supplied through a stationary inlet port located radially outside the screw-formed rotor at the meshing zone between the rotors, where new volume on rotation of the rotors is continuously formed for sucking the medium into the compressor. The inlet port extends in the axial direction of the screw-formed rotor with a substantially constant width and shows an area which is substantially in accordance with the sum of the cross-sectional areas of the grooves of the screw-formed rotor, which grooves communicate with the inlet port and in which the medium is transported further on into the compressor.

7 Claims, 12 Drawing Figures

COMPRESSOR WITH RADIAL INLET TO SCREW-FORMED ROTOR

This invention relates to rotary compressors of the type comprising at least two rotors enclosed in a housing, of which rotors a first rotor has a plurality of crests with intermediate grooves extending substantially in screw-line form and in parallel around the rotor and in which grooves protruding means of a second rotor enter in a meshing zone, the protruding means constituting one end of a suction chamber formed in the respective groove for sucking in medium which is to be compressed in the compressor. An inlet port is arranged radially outside the first rotor with confining edges located close to the crests, for supplying the medium to the section chambers, a first part of said edges being arranged to cut off the communication of the suction chambers with the inlet port on rotation of the rotors.

Such a compressor is shown in FIGS. 1–8 and 11 of U.S. Pat. No. 3,241,744. This prior compressor has two cooperating rotors, one inlet port being arranged radially outside the rotors and fully covering suction chambers in the grooves of the rotors, so that each part of the suction chambers communicates in radial direction directly with the inlet port until, on rotation of the rotors, a first part of the confining edges of the inlet port cuts of the communication of the suction chambers with the inlet port.

Upon rotation of the rotors of this prior compressor, new volume is continuously formed in the suction chambers in the grooves at the meshing zone between the rotors, at which meshing zone the medium is sucked into the suction chambers. The medium is then transported in the suction chambers towards and in under said first part of the edges of the inlet port.

Said first part of the edges of the inlet port has such an extension that the inlet port encloses a great part of the circumference of the rotors, i.e., the inlet port ends at a relatively great distance in the circumferential direction of the rotors from the meshing zone. This has the drawback that the rotors can suck in medium only at a relatively low peripheral speed of the rotors. At higher peripheral speed the medium which has been sucked in at the meshing zone will be thrown by the centrifugal force out of the grooves into the inlet port, and the ability of the rotors to suck in new medium (the coefficient of fullness) will thereby be considerably decreased.

Figure 9:
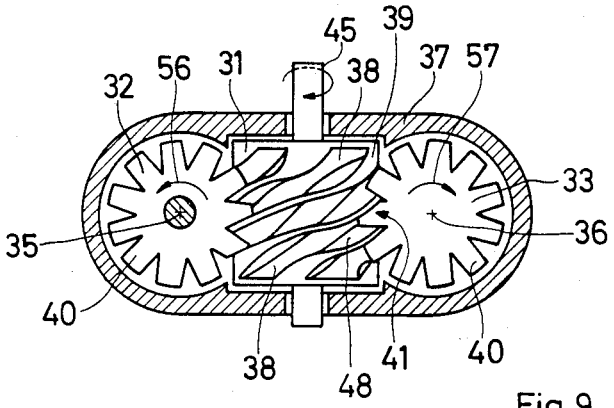

In some cases the coefficient of fullness can be improved if the inlet port is arranged at the ends of the rotors for axial supply of the medium to the rotors, as is shown in FIG. 9 of said U.S. Pat. No. 3,241,744. In this way the medium will be supplied to the grooves of the rotors at a radius which on average is less than the largest radius of the rotors, whereby the centrifugal forces which act to throw the medium out again through the inlet port will become less. The coefficient of fullness here, however, will be negatively affected by the friction losses which arise in the grooves when the medium flows through these on its way from one end of the grooves at the axial inlet port to the other end of the grooves at the meshing zone, where new volume for sucking medium into the grooves is continuously formed.

A solely axial inlet, however, allows only a limited winding angle of the grooves in the rotors, so that the inlet fully covers one end of these. At a larger winding angle, the medium must be supplied radially to the rotors.

The principal object of the present invention is to improve the coefficient of fullness of compressors of the type initially described.

In a compressor made according to the invention, the inlet port is located adjacent to the meshing zone, and a second part of said edges of the inlet port, which adjoins said first part, extends substantially in parallel with the axis of the first rotor over a plurality of suction chambers in the grooves of the first rotor, the medium on the rotation of the rotors being sucked into the suction chambers under the second part of the said edges of the inlet port. Also, the inlet port has an area which is substantially in accordance with the sum of the cross-sectional areas of the grooves into which the medium is sucked under said second part of the edges of the inlet port.

With this construction, new medium will be supplied through the inlet port to the suction chambers only in the part of these chambers where new volume is continuously formed, namely, at the meshing zone where centrifugal forces tending to throw the medium back again through the inlet port have not yet been developed. From the meshing zone and the inlet port, the medium is carried in the suction chambers by the grooves into the compressor under said second part of the edges of the inlet port without substantially moving relative to the grooves, whereby the friction losses on filling the suction chambers become small. The centrifugal forces which act through the rotation of the rotors on the medium in the suction chambers are first developed after the medium has passed in under the second part of the edges of the inlet port, whereby the medium is prevented from being thrown out again into the inlet port. By providing the inlet port with an area which is substantially in accordance with the sum of the cross-sectional area of the grooves into which the medium is sucked under the second part of the edges of the inlet port, the medium will flow from the inlet port to the grooves with substantially unchanged velocity, whereby the medium will be neither accelerated nor retarded at its entrance into the suction chambers. From a point of view of losses, this means a very favorable inflow into the suction chambers.

According to FIG. 9 of said U.S. Pat. No. 3,241,744, suction chambers of a pair of cooperating screw-formed rotors are supplied with medium through an axial inlet port located close to the crests of the rotors. Inside the inlet port, the part of the internal envelope surface of the compressor housing, which part is located just in front of the suction chambers as long as they communicate with the inlet port, is located at a substantially larger radial distance from the crests than the inlet port. Thus, the friction losses are decreased in this part of the compressor, where a narrow sealing space between the crests and the interior envelope surface of the housing is not necessary for functioning of the compressor.

This knowledge is applicable to the present invention in that, according to a further development of the invention, the part of the internal envelope surface of the housing which is located just in front of the suction chambers, as long as these communicate with the inlet port, is arranged at a substantially larger radial distance from the crests than the second part of the edges of the inlet port, which second part is shaped as a lip protruding towards the crests.

The invention is applicable to compressors of the so-called Lysholm type, e.g., according to said U.S. Pat. No. 3,241,744, where the second rotor is rotatable around an axis parallel with the rotation axis of the first rotor; and the protruding means are constituted by crests which, with intermediate grooves, extend substantially in screw-line form and in parallel around the second rotor. The grooves of the second rotor also constitute suction chambers, one end of these chambers being formed in the meshing zone by the corresponding crests of the first rotor. A common inlet port is arranged for supplying medium to the suction chambers in the grooves of both rotors, by the second part of said edges of the inlet port being located on both sides of the meshing zone.

As a result, a compressor of this type is provided with an inlet with a simple geometry for common supply of medium to the grooves of both rotors.

The invention is also applicable to compressors of the so-called Zimmern type, e.g., according to U.S. Pat. No. 3,804,564 where the second rotor has the shape of a plane, toothed disc which is rotatable around an axis forming a right angle with the rotation axis of the first rotor. The protruding means are constituted by the teeth of the disc, the edges of the inlet port having a third part which extends parallel with the plane of the disc and the axis of the first rotor close to the disc and to the crests of the first rotor.

Thus, also in this type of compressor there is obtained an inlet port according to the invention with a simple geometry, which can easily be shaped out of the housing enclosing the rotors.

Figure 1:
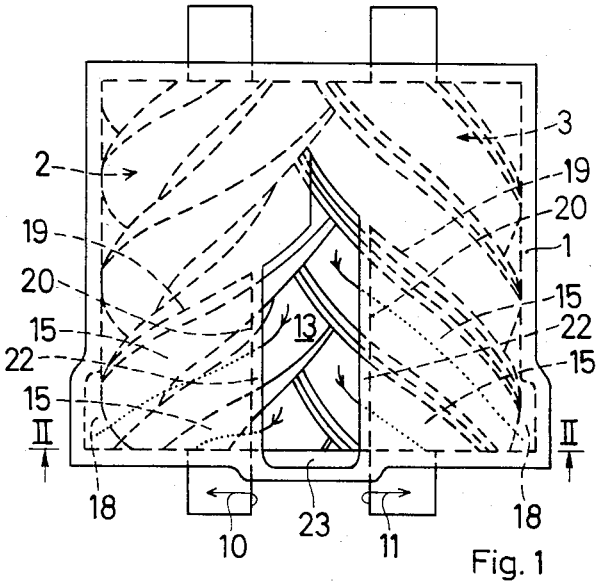
Figure 4:
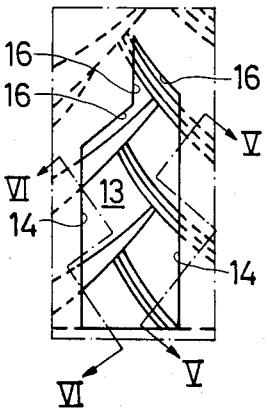
Figure 2:
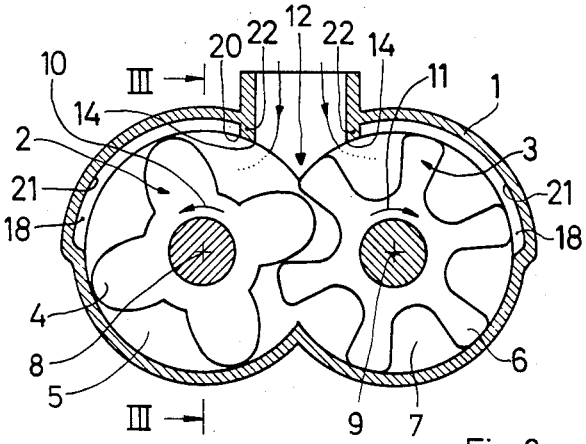
Figure 5:
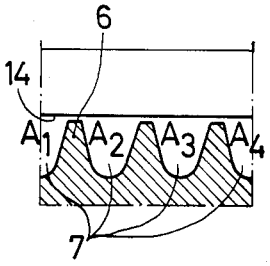
Figure 3:
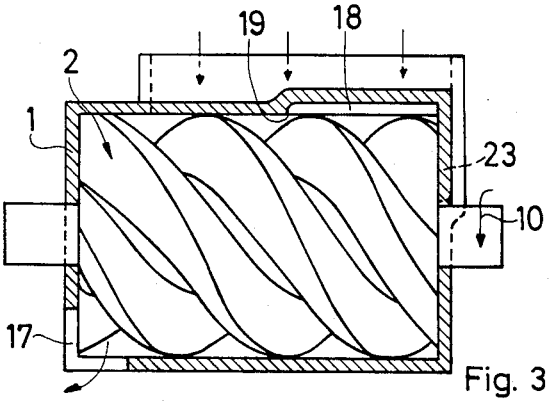
Figure 6:
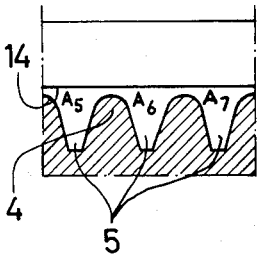
Figure 7:
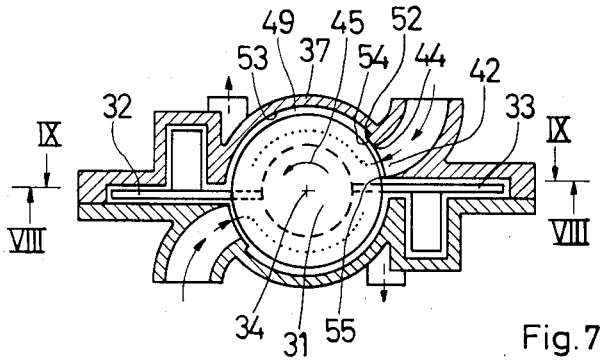
Figure 8:
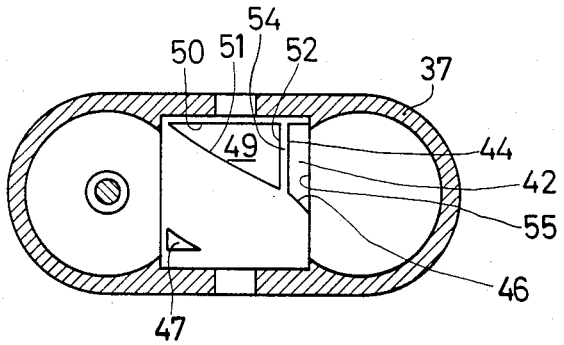
Figure 10:
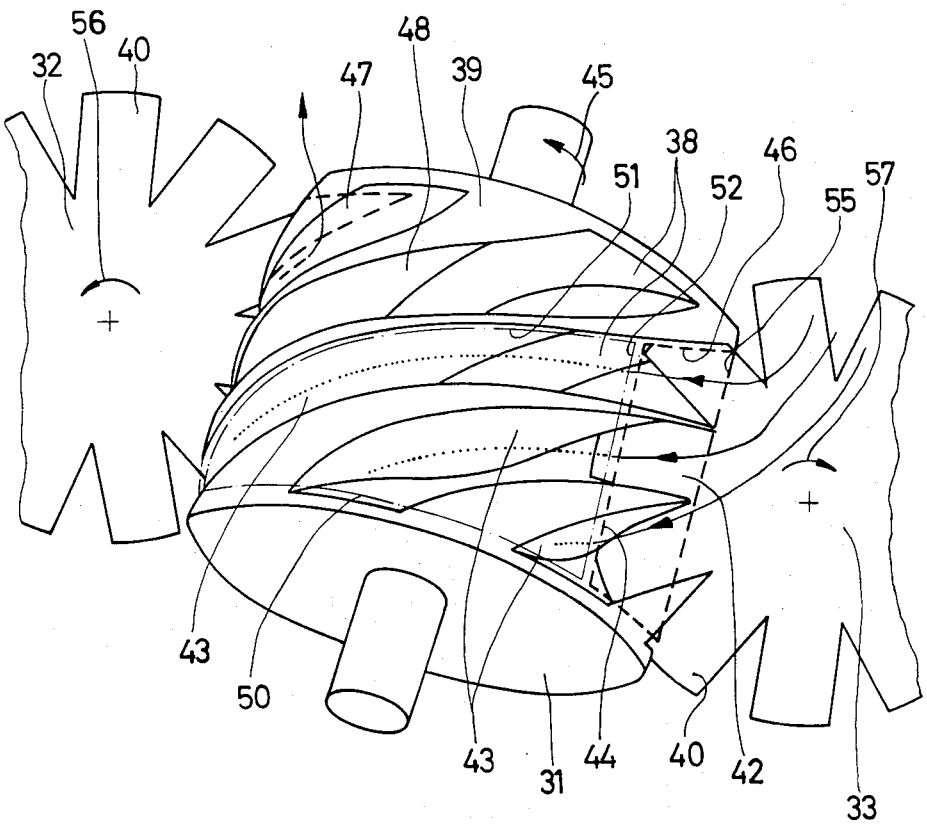
Figure 11:
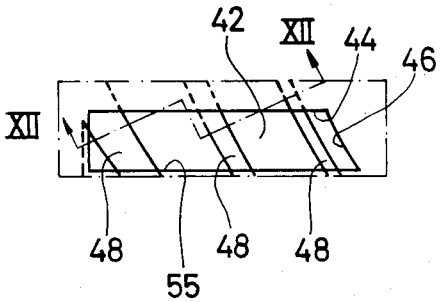
Figure 12:
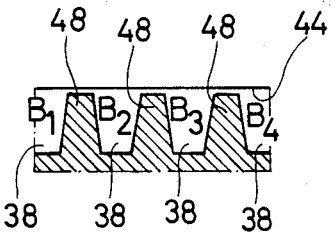

Embodiments of two different compressors according to the invention are described below in connection with the attached drawings in which FIG. 1 is a plan view of a compressor of the Lysholm type with two cooperating screw-formed rotors, FIG. 2 is a cross-sectional view of the compressor on line II—II in FIG. 1, FIG. 3 is a sectional view on line III—III in FIG. 2, FIG. 4 shows a detail of the view in FIG. 1 with an inlet port of the compressor, FIG. 5 is a sectional view on line V—V in FIG. 4 showing a part of one of the rotors and an edge of the inlet port, FIG. 6 is a sectional view on line VI—VI in FIG. 4 showing a part of the other rotor and an opposite edge of the inlet port, FIG. 7 is a cross-sectional view of a compressor of the Zimmern type, FIG. 8 is a sectional view on line VIII—VIII in FIG. 7 showing one-half of the housing of the compressor, FIG.9 is a sectional view on line IX—IX in FIG. 7 showing all the rotors of the compressor, FIG. 10 is a prespective view showing how the working chambers of the compressor according to FIGS. 7-9 work, FIG. 11 is a view showing the shape of an inlet port as seen when looking towards a rotor of the compressor, and FIG. 12 is a sectional view on line XII—XII in FIG. 11.

With reference to FIGS. 1-6, a housing 1 encloses two rotors 2,3. The rotor 2 has crests 4 and grooves 5, and the rotor 3 has crests 6 and grooves 7. These crests and grooves extend in screw-line form and in parallel around the respective rotors. The rotors are journalled in the housing for rotation around parallel axes 8 and 9 in the directions of rotation shown by arrows 10 and 11, the rotors engaging each other with their crests and grooves in a meshing zone 12.

Just in front of the meshing zone 12 an inlet port 13 is arranged for supply of the medium which is to be compressed. From inlet port 13, the medium is sucked towards the meshing zone 12 where new volume is continuously formed in the compressor, the medium then being drawn in under edges 14 of the inlet port into suction chambers 15 which are formed in the grooves 5 and 7 of the rotors. The suction chambers then move in under another edge 16 of the inlet port, which edge 16 cuts off the communication of the suction chambers with the inlet port. Thereafter the medium is compressed in the grooves 5 and 7 due to the length of the working chambers in the grooves being caused to decrease, in a well known manner, upon rotation of the rotors until an outlet port 17 of the housing 1 uncovers the working chambers and lets the compressed medium escape.

The edges 14 and 16 are located close to the crests 4 and 6 in order to prevent medium sucked in from flowing back to the inlet port 13. The edges 14 are parallel with each other and with the axes 8 and 9 of the rotors. The inlet port 13 has an area, seen toward the rotors as in FIG. 4, which is substantially in accordance with the sume of the cross-sectional areas $A_1$–$A_7$ of the grooves 5 and 7 into which the medium is sucked in under the edge 14, whereby the medium will flow through the inlet port 13 and into the grooves 5 and 7 without substantially changing its velocity. In this way, the flow losses on the introduction of the medium into the grooves will be minimal.

In order to decrease the friction losses between the crests 4, 6 and the compressor housing 1 in each part 18 of the housing, where the suction chambers 15 still communicate with the inlet port and the crests thus do not have to seal against the housing, the internal envelope surface 21 of the housing 1 at part 18 is located, inside edges 19 and 20, at a substantially larger radial distance from the crests 4, 6 than the radial distance between the edges 14 and the crests 4, 6. Each edge 14 will thus constitute a part of a lip 22 protruding towards the respective rotor, which lip prevents the medium from flowing from the space 18 to the inlet port 13.

A channel 23 extends from the inlet port 13 downwards to a place between one end of the rotors and the corresponding end wall of the housing in order to equalize the pressure in certain pockets, which can be present in the mesh between the rotors, before these pockets open radially towards the inlet port. The arrows in FIGS. 1-3 which do not have any numerals shown the flow direction of the medium in the compressor.

The compressor of the Zimmern type, as shown in FIGS. 7-12, has three rotors 31, 32, and 33 which are rotatably journalled around axes 34, 35 and 36, respectively, in a housing 37. The rotor 31, which has screw-line formed grooves 38 in a circular cylindrical envelope surface 39, cooperates with the rotors 32 and 33 which have the form of discs with teeth 40. The teeth 40 of rotor 33 engage the grooves 38 in a meshing zone 41, adjacent to which an inlet port 42 for sucking the medium into suction chambers 43 in the grooves 38 is arranged. The medium is guided into the suction chambers 43 under an edge 44 of the inlet port. On rotation of rotor 31 in the rotation direction shown by arrows 45, an edge 46 of the inlet port then cuts off the communication between the respective suction chamber 43 and the inlet port. Compression of the medium is then effected due to the working chamber in the groove being reduced in volume by the teeth 40 of the rotor 32 until the working chamber is uncovered by an outlet port 47, which allows the compressed medium to escape from the compressor. The operation described above takes place in the upper half of the compressor in FIG. 7. The lower half of the compressor is constructed and operates in the same way as the upper half, the medium being sucked in through an inlet port at the disc 32 and being compressed by the action of the teeth 40 of disc 33.

The edges 44 and 46 are located close to the crests 48 in order that medium sucked in shall be prevented from flowing back to the inlet port 42. The latter has an area, seen towards the rotor 31 as in FIG. 11, which is substantially in accordance with the sum of the cross-sectional areas $B_1$–$B_4$ of the grooves 38 into which the medium is sucked in under the edge 44, so that the medium will flow through the inlet port and into the grooves 38 without substantially changing its velocity, whereby the flow losses on the introduction of the medium into the grooves are minimal.

To decrease the friction losses between the crests 48 and the compressor housing 37 in each part 49 of the housing, where the suction chambers 43 still communicate with an inlet port and the crests thus do not have to seal against the housing, the internal envelope surface 53 of the housing 37 at part 49 is located, inside edges 50, 51 and 52, at a substantially larger radial distance from the crests 48 than the radial distance between the edge 44 and the crests 48. The edge 44 will thus constitute a part of a lip 54 protruding towards the rotor, which lip prevents the medium from flowing from the space 49 to the inlet port 42.

The rotors 32 and 33 rotate in the directions marked by arrows 56 and 57, respectively. The additional arrows in FIGS. 7 and 10, which have no numerals, show the flow direction of the medium in the compressor.

The inlet port 42 is furthermore confined by an edge 55, which extends in parallel with the disc 33 and the axis 34 of the rotor 31 close to the disc 33 as well as to the crests 48 of the rotor 31.

The inlet ports 13 and 42 described above for introduction of the medium radially into the compressor can also be combined with an inlet port (not shown) for introduction of the medium axially into the compressor.

I claim:

1. A compressor of the rotary type including a housing, at least two rotors mounted in the housing for rotation about respective axes, a first of said rotors having a plurality of crests with intermediate grooves extending substantially in screw-line form and parallel to each other around the first rotor, a second of said rotors having protruding means adapted to enter said grooves in a meshing zone of the housing, said protruding means being operable to form one end of suction chambers in respective grooves for sucking in a medium to be compressed, the housing having an inlet port for supplying said medium to the suction chambers, said inlet port being located radially outside said first rotor and provided with confining edges located close to said crests, said edges having a first part positioned to cut off communication of the suction chambers with the inlet port upon rotation of the rotors, the compressor also including the improvement in which said inlet port is located adjacent said meshing zone, said edges of the port having a second part adjoining said first part and extending substantially parallel to the axis of said first rotor over a plurality of said suction chambers in the grooves of the first rotor, said medium upon rotation of the rotors being sucked into the suction chambers under said second part of said edges, said inlet port having an area substantially equal to the sum of the cross-sectional areas of the grooves into which the medium is sucked in under said second part of said edges.

2. The compressor of claim 1, in which the housing has an internal envelope surface with an innermost portion located adjacent said suction chambers where they communicate with the inlet port, said innermost surface portion being located at a substantially larger radial distance from said crests than is said second part of said edges, said second part forming a lip protruding toward the crests.

3. The compressor of claim 1, in which said axis of the second rotor is parallel to said axis of the first rotor, said protruding means being crests which form intermediate grooves of the second rotor, said crests and grooves of the second rotor extending substantially in screw-line form and parallel to each other around the second rotor, said grooves of the second rotor forming additional suction chambers, said crests of the first rotor being operable in said meshing zone to form one end of said additional suction chambers, said inlet port being arranged to supply said medium to said suction chambers in the grooves of both rotors, said second part of the edges of the inlet port being located on both sides of said meshing zone.

4. The compressor of claim 2, in which said axis of the second rotor is parallel to said axis of the first rotor, said protruding means being crests which form intermediate grooves of the second rotor, said crests and grooves of the second rotor extending substantially in screw-line form and parallel to each other around the second rotor, said grooves of the second rotor forming additional suction chambers, said crests of the first rotor being operable in said meshing zone to form one end of said additional suction chambers, said inlet port being arranged to supply said medium to said suction chambers in the grooves of both rotors, said second part of the edges of the inlet port being located on both sides of said meshing zone.

5. The compressor of claim 1, in which said second rotor has the shape of a planar toothed disc and has its said axis at right angles to said axis of the first rotor, the teeth of said disc forming said protruding means, said edges of the inlet port also having a third part extending parallel to the plane of said disc and to said axis of the first rotor, said third part extending close to both said disc and said crests of the first rotor.

6. The compressor of claim 2, in which said second rotor has the shape of a planar toothed disc and has its said axis at right angles to said axis of the first rotor, the teeth of said disc forming said protruding means, said edges of the inlet port also having a third part extending parallel to the plane of said disc and to said axis of the first rotor, said third part extending close to both said disc and said crests of the first rotor.

7. The compressor of claim 5, comprising also a second said planar toothed disc, said two discs having parallel rotation axes and being located at opposite sides of said first rotor, the teeth of said second disc forming a second said protruding means, the housing having a second inlet port for supplying a said medium to suction chambers in said grooves of the first rotor, said second inlet port having edge parts corresponding to said first, second and third parts of the other inlet port.

* * * * *